United States Patent [19]

Asari et al.

[11] 4,230,661

[45] Oct. 28, 1980

[54] INDIRECT EXTRUSION PROCESS

[75] Inventors: Akira Asari, Osaka; Masakazu Ueda; Takeo Nishimoto, both of Kobe, all of Japan

[73] Assignee: Kobe Steel, Limited, Kobe, Japan

[21] Appl. No.: 946,331

[22] Filed: Sep. 27, 1978

[30] Foreign Application Priority Data

Oct. 15, 1977 [JP] Japan ..... 52-123908

[51] Int. Cl.[3] ..... B29D 23/00

[52] U.S. Cl. ..... 264/323; 264/292; 425/393; 425/398

[58] Field of Search ..... 264/320, 570; 425/364, 425/398, 399, 400, 326, 380, 393

[56] References Cited

U.S. PATENT DOCUMENTS

| | | | |
|---|---|---|---|
| 1,528,263 | 3/1925 | Peelle | 264/320 |
| 1,606,729 | 11/1926 | Boal et al. | 425/398 |
| 2,953,816 | 7/1960 | Kidder | 425/398 |
| 3,214,505 | 10/1965 | Pierkowski et al. | 264/320 |
| 3,271,502 | 9/1966 | Wentorf | 264/320 |
| 4,051,505 | 3/1978 | Kawai | 264/320 |

OTHER PUBLICATIONS

"MEtal Forming: Processing and Analysis" by Avitzuv, McGraw Hill Pub., N.Y., pp. 250-255, 1968.

Borg Warner Technical Bulletin "Cold Forming" P.B-138 p. 17, Apr. 1969.

*Primary Examiner*—Jay H. Woo

*Attorney, Agent, or Firm*—Oblon, Fisher, Spivak, McClelland & Maier

[57] ABSTRACT

An indirect extrusion process making use of an apparatus having a main ram and a container which are adapted to be driven independently of each other, the container being moved during the extrusion at a speed equal to or higher than that of the main ram, so as to produce the extrusion force, characterized in that the movement of the container relative to the main ram is prevented so that the power for moving the container may be added to the extrusion force, so as to effect extrusion without causing change in the relative position between the container and the billet during extrusion, and that the main ram and the container are connected at a desired position in accordance with the length of the billet, making use of the frictional force exerted between the container and said billet, such that extrusion may be effected with respect to container and the billet in connected state of operation.

4 Claims, 7 Drawing Figures

INDIRECT EXTRUSION PROCESS

BACKGROUND OF THE INVENTION

1. Field of the Invention

This invention relates to an extrusion process, and more particularly to an indirect hot extrusion process in which a container is moved while an extrusion die is kept stationary.

2. Description of Prior Art;

Conventionally, there have been adopted three major indirect extrusion processes. One of these conventional processes involves keeping the container freely movable during the extrusion, while the billet is pressed by a pressing stem from the opposite side to the fixed die, so that the container may be moved ahead by the static frictional force between the billet and the container, thereby effecting extrusion without causing any dynamic friction between the billet and the container. Another conventional process is characterized by the container and the main ram being held in contact with each other during the extrusion, such that the container is pushed ahead by the main ram, to thereby extrude the billet from the extrusion port formed in the front-side of the stationary die.

The third conventional process is to provide an independent cylinder for moving the container, so that the container may be moved independently even during the extrusion.

The first-mentioned conventional process has a drawback in that, as the billet in the container becomes short as the end period of the extrusion, static friction occurs between the container and the billet so that the container cannot be further moved ahead. Meanwhile, the pressurizing system thereof continues to move ahead, so that the billet is moved relatively to the container so as to cause a so-called direct extrusion effect, resulting in a deteriorated quality of the product at the end of the extrusion.

In the second-mentioned conventional process, the aforementioned relative movement does not take place. However, since the power required for the forward movement required for purposes other than the extrusion is for forward movements only, as in the first-mentioned process, it has been impossible to achieve the mutual connection of the container and the stem at the position corresponding to the length of the billet.

In the third-mentioned conventional process, the container and the ram can move together if the friction between the billet and the ram is sufficiently large. However, if the friction is too small, only the container is moved ahead, to the contrary of the first-mentioned process, so that the extrusion plate and the billet are exposed from the rear end of the container, or, alternatively, the ram is moved ahead with the container having moved to the end of its forward stroke, so as to cause the aforementioned direct extrusion effect.

SUMMARY OF THE INVENTION

The purpose of this invention is to overcome the above mentioned problems of the prior art, and to effectively achieve all objects hereinafter mentioned.

The primary object of this invention is to provide an indirect extrusion process making it possible to effect connection between the container and the stem or between the container holder and the crosshead, at any desired relative position, in accordance with the length of the billet.

It is another object of the invention to increase the effective extrusion power by adding the container moving power to the extrusion force.

It is still another object of the invention to maintain a correct positional relationship between the container and the stem, even after the extrusion is advanced to make the friction between the billet and the container smaller, so as to avoid the degradation of the quality of the product which is likely to be caused at the end part of the extrusion stroke due to the direct extrusion effect.

In order to achieve the above and the other objects of the invention, the following aspects of the invention are proposed.

The first aspect of the invention is an indirect extrusion process making use of an apparatus having a main ram and a container which are adapted to be driven independently of each other, the container being moved during the extrusion at a speed equal to or higher than that of the main ram, so as to produce the extrusion force, characterized in that the movement of the container relative to the main ram is prevented so that the power for moving the container may be added to the extrusion force so as to effect the extrusion without causing change in the relative position between the container and the billet during the extrusion, and that the main ram and the container are connected at a desired position in accordance with the length of the billet through use of the frictional force exerted between the container and the billet, so that extrusion may be effected with respect to the container and the billet in a connected state of operation.

The second aspect of the invention is related to the indirect extrusion process of the first aspect, in which the pressure in the cylinder apparatus of the hydraulic coupling is continuously increased over a period starting an instant after the friction between the container and the billet has grown to exceed the forces of the coupling cylinder and the container shifting cylinder, and ending an instant immediately before the frictional force is reduced to a point below the forces of both cylinders due to the exhaustion of the length of the billet as the extrusion proceeds.

The third aspect of the invention is related to the indirect extrusion press of the first aspect in which the pressure in the coupling cylinder is kept elevated over a period of time which starts after the upsetting of the billet and after piercing the billet, and after the friction subsequent to the frictional force between the billet and the container exceeding the powers of the coupling cylinder and the container shifting cylinder and ending immediately before the friction comes down below the forces of these two cylinders.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Hereinafter, a practical embodiment of the invention will be described with reference to the accompanying drawings.

Figure 1:
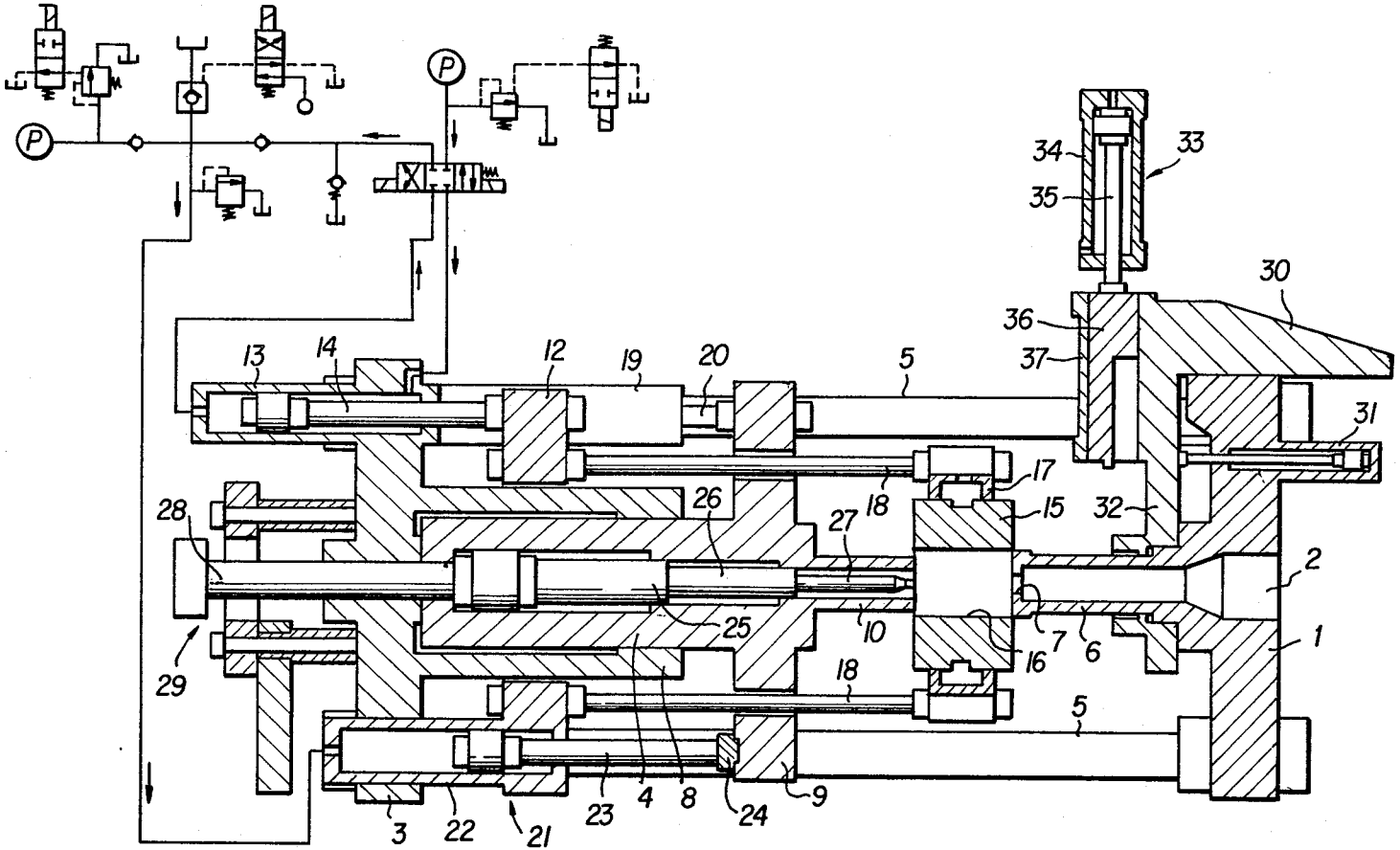
FIG. 1 is a side elevational sectional view of a press machine with which method of the invention is accomplished.

Referring first to FIG. 1 showing the press machine in sectional side elevation, a press platen 1 having a through bore 2 formed at its center is disclosed. Reference numeral 5 denotes a cylinder frame, at the front side portion of which is received a main ram 4.

Hereinafter, the direction of movement of effecting the extrusion will be referred to as "forward direction" of "front side", while the opposite direction will be referred to as "backward direction" or "rear side." The press platen 1 and the main cylinder frame 3 are mounted on a press bed (not shown) so as to oppose each other in the forward and backward directions. Both such members are rigidly connected to each other through a plurality of columns 5 which are disposed on the diagonal lines, so as to form a press column body of Rahmen structure.

A die stem 6 is rigidly held at the press center of the press platen 1, by means of a hydraulic jack, tension bolts and other members which are not shown, and extends backwardly. The die stem 6 has an elongated cylindrical form. A die 7 for determining the outer diameter of the product is attached to the rear end of the die stem 6, through a die holder.

The main ram 4 is received by a main cylinder 8, and carries a pressurizing stem 10 through a crosshead 9. The pressurizing stem 10 is disposed on the axis of the press at the front part of the latter. At each press cycle, an extrusion plate 11 is fed along with the billet A into the press and disposed in front of the front end portion of the pressurizing stem 10.

A container shifting frame 12 is disposed between the front press platen 1 and the main cylinder frame 3, and between the main cylinder frame 3 and the crosshead 9. The container shifting frame 12 is materially penetrated by the main cylinder 8. A container shifting cylinder 13 is provided so as to extend backwardly from the main cylinder frame 3, and slidably receives a piston. The piston 13 has a piston rod 14 which is connected at its end to the container shifting frame 12.

A container denoted by a reference numeral 15 has a bore 16 for accomodating the billet, in alignment with the axis of the press, and is movably disposed between the crosshead 9 and the press platen 1, in the direction of the movement of the press. A container holder 17 is connected to the container shifting frame 12 through a plurality of tie rods 18. These tie rods 18 extend through the crosshead 9. A side cylinder 19 is provided to extend forwardly from one side of the main cylinder frame 3. This side cylinder 19 has a piston rod 20 which is connected at its end to the crosshead 9.

A cylinder apparatus 21 for the hydraulic coupling has a cylinder 22 which extends backwardly from the side of the container shifting frame 12, so as to be received and supported by the main cylinder frame 3. The rod 23 of a piston adapted to slide in the cylinder 22 is adapted to be brought into and out of contact with an abutment block 24 provided on the rear end surface of the crosshead 9.

A mandrel piston 25 is received by a cylinder formed in the main ram 4, and carries a mandrel 27 through a mandrel holder 26. The mandrel 27 has a tip by which the inner diameter of the product is determined, and is accomodated by the pressurizing stem 10 in alignment with the axis of the press.

The mandrel piston 25 has a tail rod 28 which extends backwardly through the main cylinder 3. The tail rod 28 is further provided with a mechanical mandrel locking means 29.

A shear column 30 is adapted to be moved back and forth in the direction of the press by means of a cylinder apparatus 31 along the press platen 1. The shear column 30 has a support arm 32 which is adapted to hold the die stem 6 in the longitudinal direction during the extrusion and to hold the rear end of the die stem 6 when the product is separated from the portion to be discarded.

A vertical shear assembly 33 includes a cylinder 34, a piston having a piston rod 35 and a shear 36 attached to the piston rod 35. A shear guide sleeve 37 formed in the shear assembly 30 movably receives the shear 36 in the direction at a right angle to the direction of the press, beyond the axis of the press. Further, as shown in FIG. 2, a billet loader 38 is disposed at the rear side of the container for free rotation around the axis of a container tie rod 18.

The invention will be readily understood from the following description of a cycle of operation of the press having the above described construction.

Figure 2:
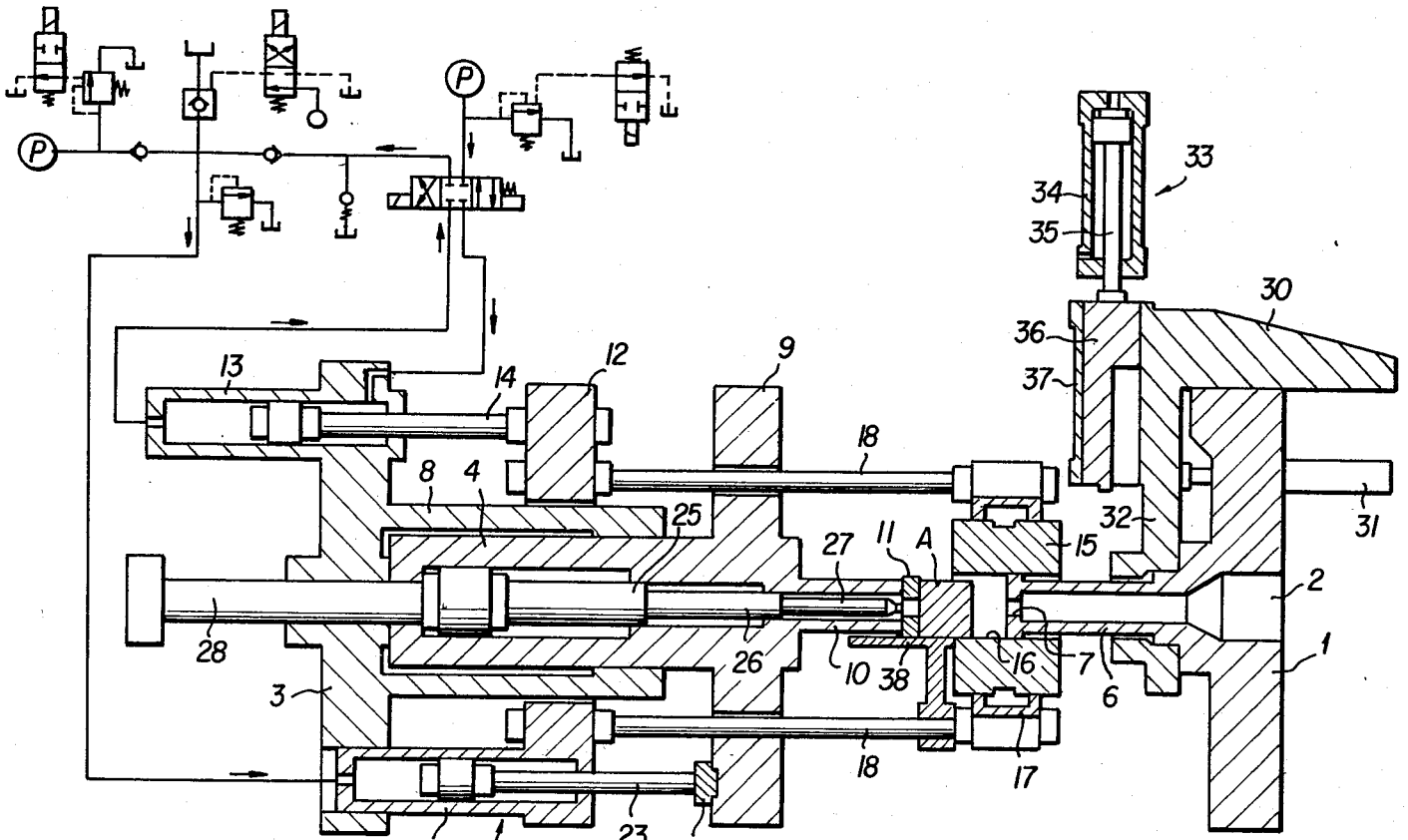
FIG. 2 is a side elevational sectional view of the press machine as shown in FIG. 1 during the step of loading with billet.

In the operational state as shown in FIG. 1, the bore 16 of the container 15 has not yet been loaded with the billet A, while FIG. 2 shows the press loaded with the billet A. Referring first to FIG. 1, as the working pressurized oil is supplied to the forwarding side of the container shifting cylinder 13, the container shifting frame 12 is moved forwardly so that the container 15 is moved to cover the die stem 6.

As the die stem 6 is covered by the container 15 to such an extent that the clearance between the rear end surface of the container 15 and the front end surface of the pressurizing stem 10 becomes large enough to receive the billet loader 38, the forward movement of container 15 is ceased.

Then, after placing the extrusion plate 11 and the billet A on the billet loader 38, the latter is swung to a position on the axis of the press. Subsequently, the working oil is supplied to the reversing side of the container shifting cylinder 13. Consequently, the container 15 is moved backward as shown in FIG. 2, so that the bore 16 of the container 15 is loaded with the billet A with the extrusion plate 11 disposed at its side close to the pressurizing stem 10.

After the loading, the billet loader 38 is swung out of the press. Subsequently the working oil is supplied to the forwarding side of the side cylinder 19, so that the main ram is moved forwardly with no load, so as to prepare for extrusion.

Then, in the illustrated practical embodiment, the piercing of the billet is subsequently effected resulting in the upsetting step of the same. The upsetting is accomplished in the following manner. As the working oil is fed to the forwarding sides of the main cylinder 8 and the side cylinder 10, the main crosshead is moved again forwardly, so that the container 15 is fully loaded with the billet A. Then, in order to correct the elongation of the billet A during the piercing, the pressurizing stem is moved slightly backward. Then, as the working oil is supplied to the forwarding side of the mandrel piston 25, the mandrel 27 is solely moved in the forward direction, such that a piercing is effected until the tip of the mandrel 27 comes to face the die 7 of the die stem 6. The relative position of the die 7 and the mandrel tip is fixed by means of a mechanical locking means 29.

Figure 3:
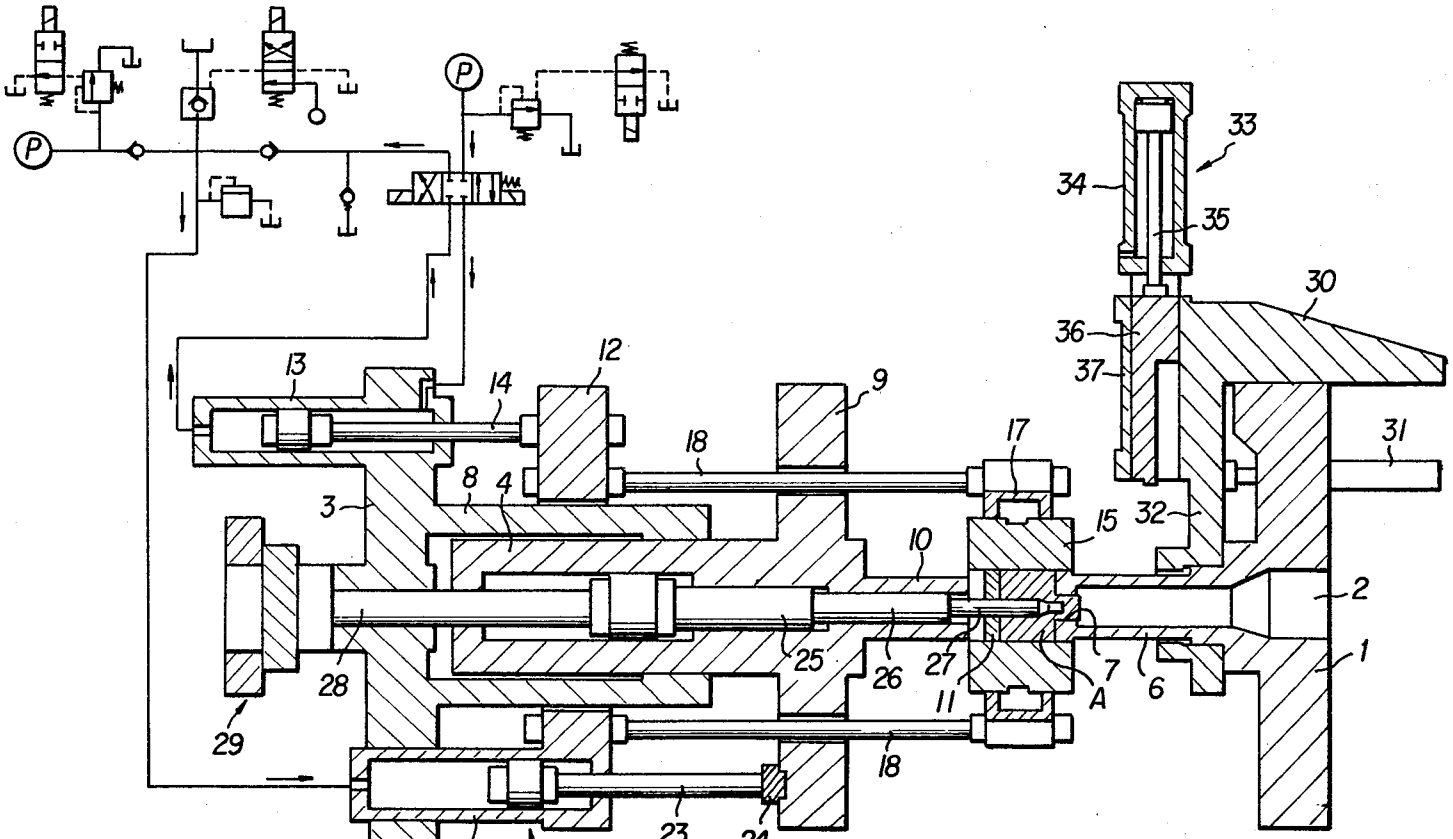
FIG. 3 is a side elevational view of the press machine during the upsetting step.
Figure 4:
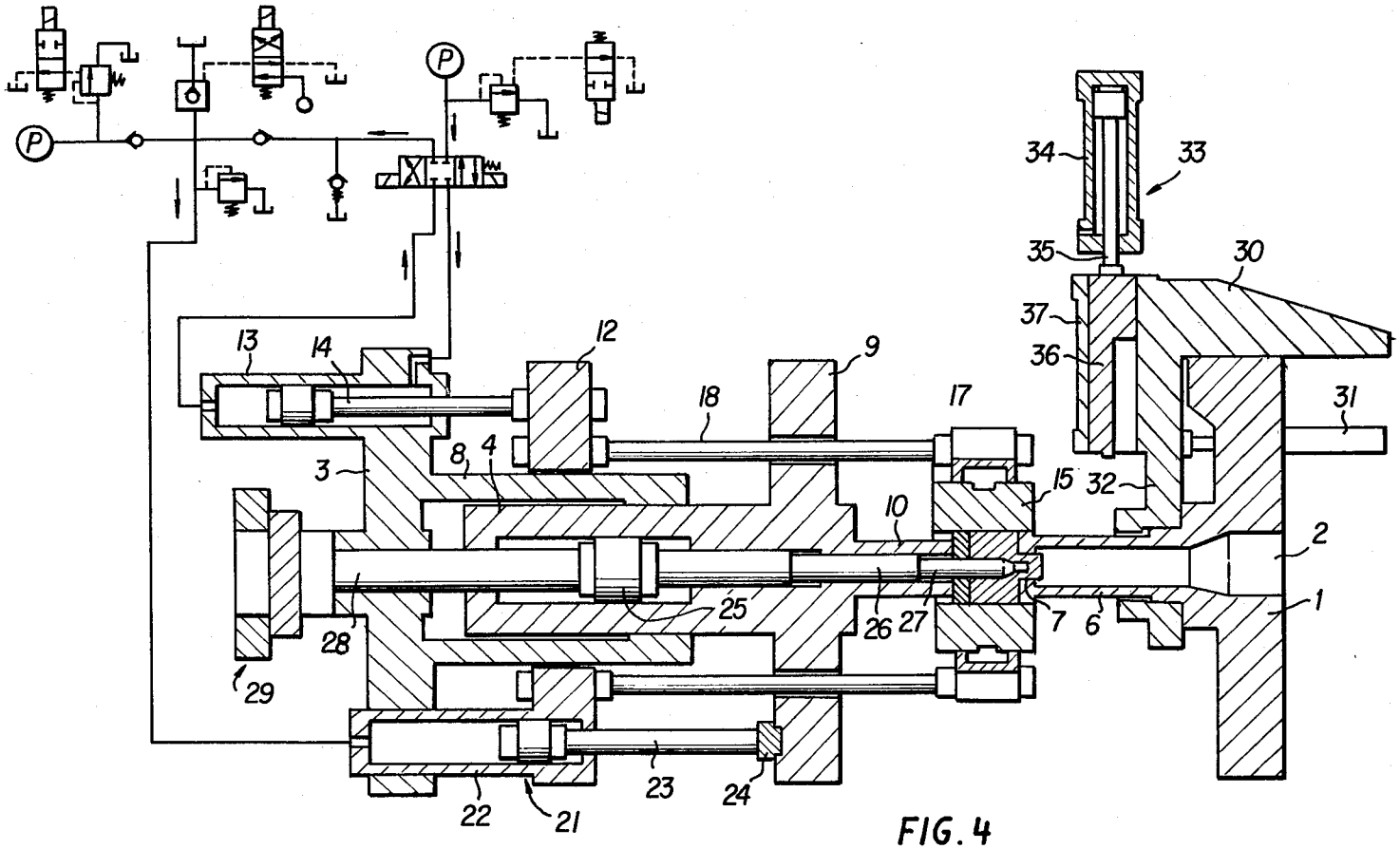
FIG. 4 is a side elevational view of the press machine during the piercing step.

FIG. 3 shows the state in which the piercing has been finished, while FIG. 4 shows the press in the state in which the pressurizing stem is moved ahead with no load so as to commence the extrusion.

In the state in which the piercing of the billet A has been finished, the tip of the mandrel 27 comes into the die bore of the die stem 6 so that the space determining the cross-section of the extruded product is defined by the wall of the die bore and the surface of the tip.

Then, as the working oil is supplied to the forwarding sides of the container shifting cylinder 13, side cylinder 19 and the main cylinder 8, the container 15 and the pressurizing stem 10 are moved ahead simultaneously so that the billet A is extruded from the extrusion bore defined by the die stem 6 and the mandrel 27, while the container 15 is fixed in relation to the main ram 4.

In this connection, if the delivery rate of the pump is so adjusted that the speed of movement of the container shifting cylinder 13 is greater than the speed of the main ram 4, the power for shifting the container is added to the extrusion force through the billet, so as to assist the extrusion when no working oil is supplied to the hydraulic coupling cylinder. Further, due to the friction between the billet and the container, the power for shifting the container is synchronized with the movement of the stem.

As mentioned before, the piston rod 14 of the container shifting cylinder 13 is connected to the container shifting frame 12. At the same time, the container shifting frame 12 and the container 15 are connected to each other through tie rods 18. Further, the crosshead 9 of the container shifting frame 12 is in contact with the cylinder apparatus 21 of the hydraulic coupling. Therefore, as the working oil is supplied to the hydraulic coupling, the power for shifting the container is added to the power for shifting the main ram, i.e. to the extrusion force, during the extrusion.

In order to make it possible to connect the main ram 4 and the container 15 at any desired position in accordance with the length of the billet, making use of the static friction between the container 15 and the billet A, the timing at which the pressure in the cylinder apparatus or coupling cylinder 21 of the hydraulic coupling is raised has substantial significance. This pressure is increased within a period starting at an instant after the completion of the upsetting or piercing and after the friction between the container 15 and the billet A has grown to exceed the forces of the coupling cylinder 21 and the container shifting cylinder 13 and ending immediately before the frictional force decreases to a point below the forces of both cylinders due to the exhaustion of the length of the billet A as the extrusion proceeds. Consequently, the power for shifting the container is added to the extrusion force through the cylinder 21 for the hydraulic coupling.

The working oil is thus supplied to the pressurizing side of the cylinder 21 of the hydraulic coupling so that the main ram and the container 15 may be connected through making use of the friction between the billet A and the container 15 and so that the positional relationship between these two parts may be fixed until the frictional force has been reduced.

Needless to say, the container shifting cylinder 13 and the cylinder 21 for the hydraulic cylinder are designed to have the same power. As stated before, the pressure in the coupling cylinder 21 is kept elevated over a period which starts after the upsetting of the billet or, in case of the extrusion of hollow article as in the illustrated embodiment, after the piercing of the billet, and after the frictional force between the billet A and the container 15 comes to exceed the powers of the coupling cylinder 21 and the container shifting cylinder 13 and ending immediately before the frictional force decreases to a point below the forces of these two cylinders. As far as this requisite is met, the coupling effect can be obtained irrespective of whether both of the cylinders may be supplied with the working oil concurrently or either one of the cylinders is supplied with the working oil prior to the other.

Figure 5:
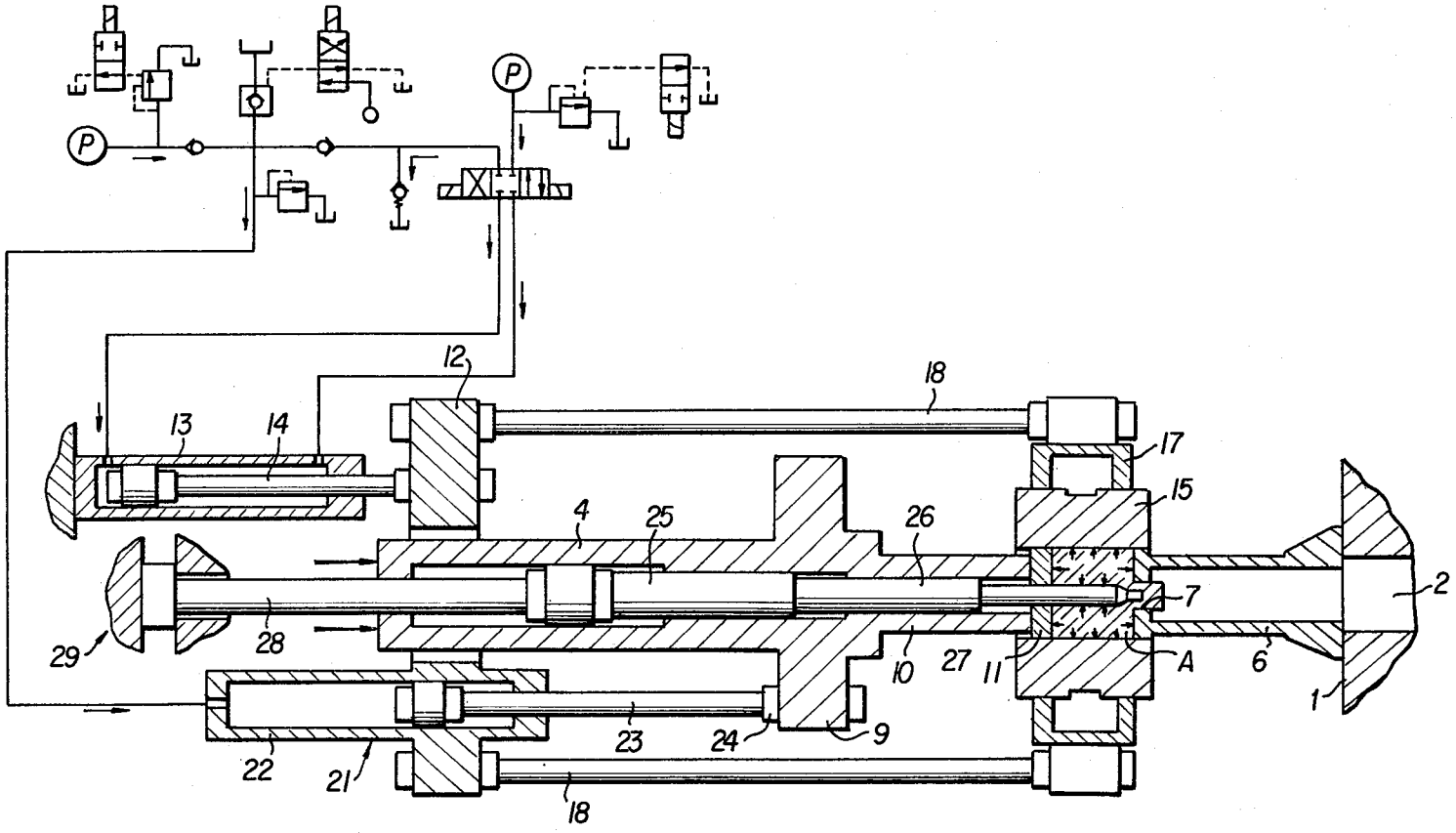
FIG. 5 is a sectional view of the press machine during the operational state immediately before the extrusion step.
Figure 6:
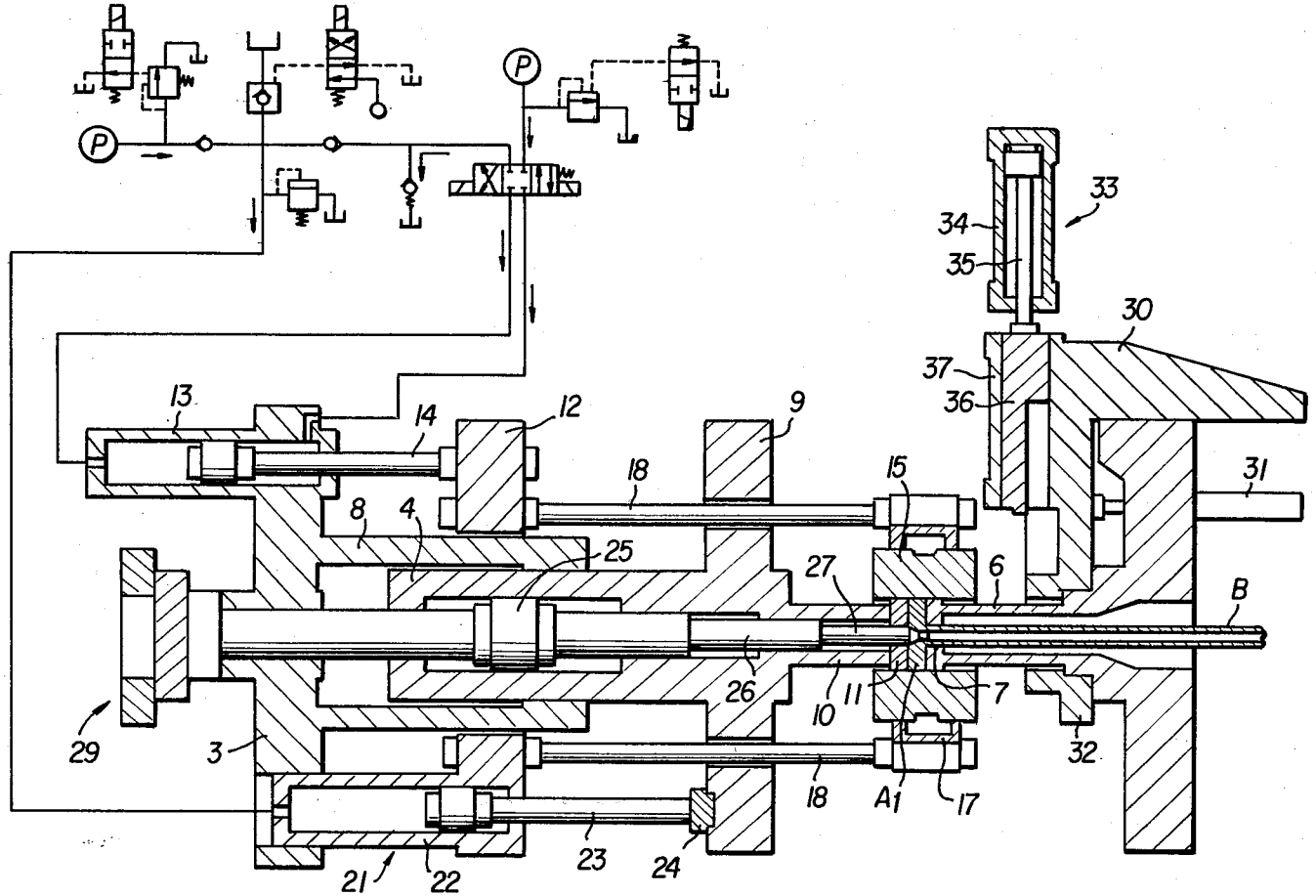
FIG. 6 is a sectional view of the press machine during the operational state after extrusion.

FIG. 5 shows the press in the state immediately before the extrusion, while FIG. 6 shows the press in the operational state in which the extrusion has been completed. In FIG. 6, the extruded article is represented by a symbol B.

During the extrusion, the extrusion power is applied to the die stem 6. In the illustrated embodiment, since the die stem 6 is supported at its longitudinal central portion by the support arm 32, the precision of the die stem 6 is maintained and degradation of the quality of the extruded article B is avoided.

It is further necessary to sever the extruded article B from the portion to be discarded $A_1$. This is carried out in the following manner. The working oil is supplied to the reversing side of the mandrel piston 25, while the main cylinder 8 is released from the pressure of the working oil and while the mechanical locking means 29 is unlocked. Consequently, the mandrel 27 is extracted from the article and the discarded portion $A_1$. Then, the forwarding side of the side cylinder 19 is supplied with the working oil, so that the pressurizing stem 10 is forcibly stopped. At the same time, the working oil is supplied to the reversing side of the container shifting cylinder so that the discarded portion $A_1$ is ejected to the front side of the container 15 through the cooperation with the reversing of the container 15. Then, as the cylinder apparatus 31 is supplied with the working oil, after reversing the pressurizing stem, the shear column 30 as a whole is moved backward. By supplying the working oil to the shear cylinder 34 while the rear end of the die stem 6 is supported by a support arm 32 as shown in FIG. 7, the shear 36 is moved in the direction perpendicular to the direction of the press movement, toward the axis of the press, so as to sever the article B from the discarded portion $A_1$ is ejected out of the press, together with the extrusion plate 11 attaching thereto.

Figure 7:
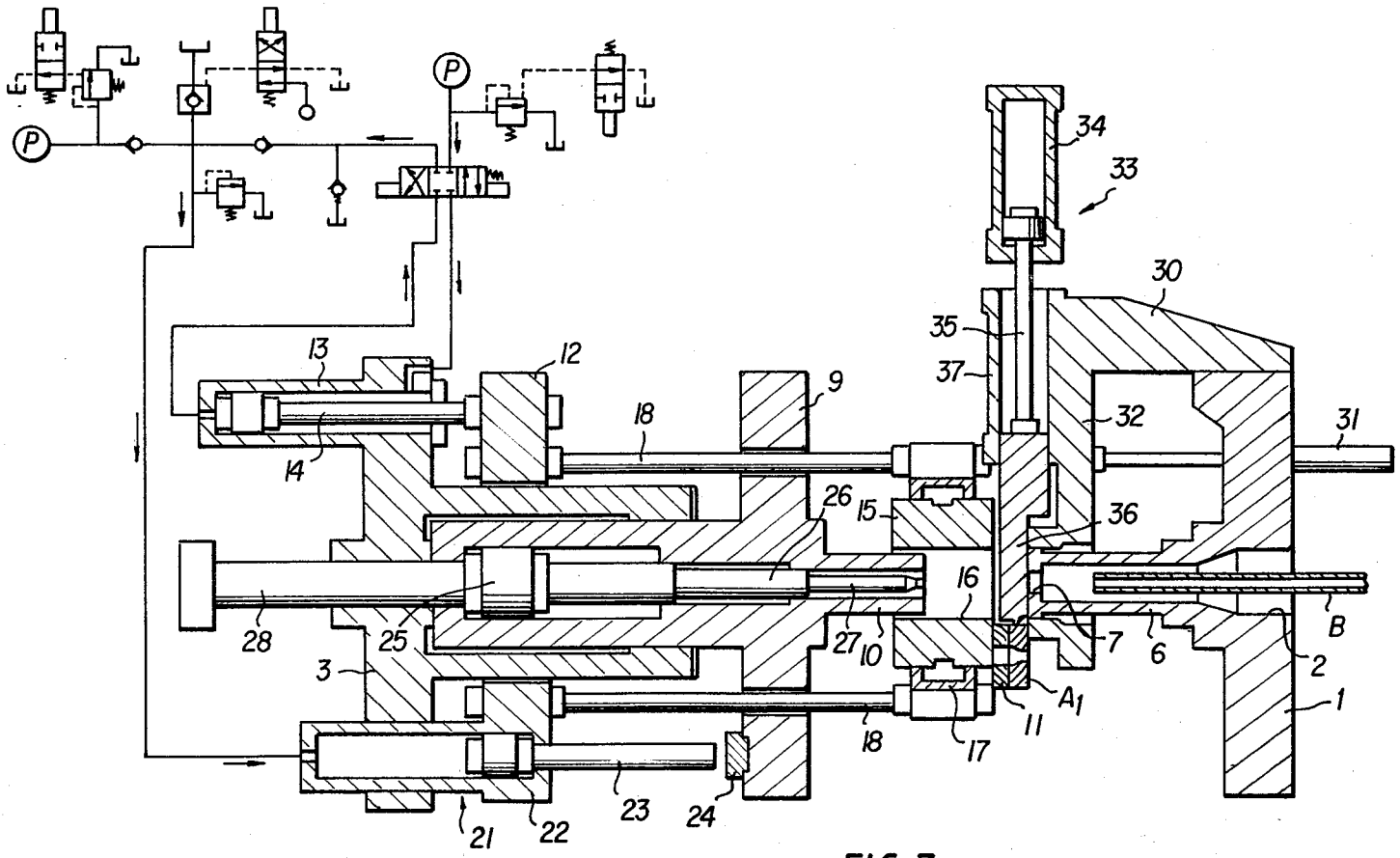
FIG. 7 is a sectional view of the press machine during the shearing step.

This shearing step is shown in FIG. 7. During this shearing, a large shearing force is transmitted to the die stem 6, so that a large bending moment is applied to the elongated cylindrical die stem 6. However, the support arm 32 which holds the die stem 6 provided a back-up effect large enough to withstand the large shearing force, so as to ensure the precision of the die stem 6. After the shearing step has been completed, the parts of the press is returned to resume the starting positions as shown in FIG. 1, thus completing one cycle of the press operation.

As has been described, according to the invention, the power for shifting the container is added to the extrusion power, in cooperation with the coupling cylinder, so that a larger effective pressing force can be obtained. At the same time, is it possible to connect the container and the stem to each other at any desired position corresponding to the length of the billet by means of the hydraulic coupling.

Further, an indirect extrusion is performed even after the static friction between the billet and the container has come down, due to the exhaustion of the billet as the extrusion proceeds, so that the degradation of the quality of the extrusion product, attributable to slip between the container and the billet, can be avoided.

Obviously, many modifications and variations of the present invention are possible in light of the above teaching. It is therefore to be understood that within the scope of the appended claims the invention may be practiced otherwise than as specifically described herein.

What is claimed as new and desired to be secured by Letters Patent of the United States is:

1. An indirect hot extrusion process with an extrusion apparatus having a die member operatively associated with a main ram and a container which are adapted to be driven independently of each other, said container being moved during extrusion at a speed equal to or greater than that of said main ram, so as to produce an extrusion force on a billet mounted in said container for cooperation with said die member comprising:

loading said billet in said container;

extruding said billet at least partially through said die member; and preventing movement of said container relative to said main ram and adding power for moving the container to the extrusion force so as to effect the extrusion without causing change in the relative position in accordance with the length of said billet by use of frictional force exerted between said container and said billet, so that the extrusion may be effected with respect to said container and said billet in a connected state of operation.

2. The indirect extrusion process of claim 1, wherein the extrusion apparatus includes a container shifting cylinder, a hydraulic coupling with a coupling cylinder and further comprising increasing pressure in the coupling cylinder of the hydraulic coupling with a period starting at an instant after the frictional force between the container and the billet exceeds the forces of the coupling cylinder and the container shifting cylinder, and ending at an instant immediately before the frictional force is decreased below the forces of both cylinders due to the exhaustion of the length of the billet as the extrusion proceeds such that power for shifting the container is added to the force of extrusion.

3. The indirect extrusion process of claim 2, further comprising maintaining the pressure in the cylinder apparatus of the hydraulic coupling at an elevated value, after increasing pressure until extrusion is completed.

4. The indirect extrusion process of claim 1, which further comprises shearing said billet after extruding said billet at least partially through said die member.

* * * * *